US005768817A

United States Patent [19]

Simons

[11] Patent Number: 5,768,817

[45] Date of Patent: Jun. 23, 1998

[54] GUN HANDLE GRIP

[76] Inventor: Terence J. Simons, 9020 Fir Dr., Thornton, Colo. 80229

[21] Appl. No.: 789,854

[22] Filed: Jan. 28, 1997

[51] Int. Cl.[6] ..... F41C 23/00; F41A 9/62

[52] U.S. Cl. ..... 42/71.02; 42/1.02

[58] Field of Search ..... 42/71.02, 74, 1.02

[56] References Cited

U.S. PATENT DOCUMENTS

| | | | |
|---|---|---|---|
| D. 257,166 | 9/1980 | Hogue | 42/71.02 X |
| 954,904 | 4/1910 | White | 89/196 |
| 1,028,032 | 5/1912 | Krag | 89/196 |
| 3,195,408 | 7/1965 | Sherman | 89/196 |
| 3,758,978 | 9/1973 | Theodore | 42/71.02 |
| 4,043,066 | 8/1977 | Pachmayr et al. | 42/71.02 |
| 4,286,401 | 9/1981 | Pachmayr et al. | 42/71.02 |
| 4,359,833 | 11/1982 | Pachmayr et al. | 42/71.02 |
| 4,378,651 | 4/1983 | Pachmayr et al. | 42/71.02 |
| 4,558,626 | 12/1985 | Bartolles | 89/24 |
| 4,833,812 | 5/1989 | Farrar | 42/71.02 |
| 4,936,036 | 6/1990 | Sniezak et al. | 42/71.02 |
| 5,142,805 | 9/1992 | Horne et al. | 42/1.02 |
| 5,206,444 | 4/1993 | Oliver | 42/1.02 |
| 5,231,237 | 7/1993 | Cupp | 42/71.02 |
| 5,465,520 | 11/1995 | Cupp | 42/71.02 |

OTHER PUBLICATIONS

Pyle, Here is Your War; Holt and Co., Inc; 1943, p. 301, Oct. 1943.

*Primary Examiner*—Michael J. Carone
*Assistant Examiner*—Matthew J. Lattig
*Attorney, Agent, or Firm*—Aquilino & Welsh

[57] ABSTRACT

A gun handle grip including a first grip member and a second grip member. The first grip member has a first shell and a first reinforcing member bonded to an inner surface of the first shell and the second grip member has a second shell and a second reinforcing member bonded to an inner surface of the second shell. The inner surface of the first shell includes a first recess shaped to receive the first reinforcing member and the first reinforcing member is bonded to the first shell within the first recess. Similarly, the inner surface of the second shell includes a second recess shaped to receive the second reinforcing member and the second reinforcing member is bonded to the second shell within the second recess. The grip is further provided with structure for releasably securing the first grip member and the second grip member to opposite sides of the handle of a firearm. The gun handle grip provides a user with a comfortable gripping surface through which he or she may view the number of rounds remaining in the magazine compartment.

20 Claims, 3 Drawing Sheets

GUN HANDLE GRIP

BACKGROUND OF THE INVENTION

1. Field of the Invention

The invention relates to gun handle grips. More particularly, the invention relates to gun handle grips including a viewing window through which an individual may view the number of rounds remaining in a magazine compartment.

2. Description of the Prior Art

Hand guns are commonly provided with a handle portion extending downwardly and rearwardly from the frame of the gun. The handle portion of a gun is generally covered with a grip. The grips provided with hand guns are often not suited for individual users, and it is, therefore, desirable to replace the manufacturer's grip with a new, more comfortable grip. Many prior attempts have been made to provide replacement grips commonly found on hand guns. However, these prior attempts have met limited success, and are commonly difficult to manufacture and use.

In addition, it is desirable to provide gun users with a means for revealing the contents of a magazine. Specifically, many automatic and semiautomatic firearms do not contain structure for indicating the number of rounds of ammunition contained in the firearm. As a result, a well recognized problem in both competitive and combat shooting situations is the inability of the firearm user to be confident of the number of rounds of ammunition remaining in his or her firearm.

A user typically knows the maximum cartridge capacity of his or her firearm, and usually knows the number of rounds the firearm contains upon loading. After firing the firearm, however, the user is typically less certain of the number of rounds remaining. When automatic weapons are shot, the user only has a general idea of the number of rounds remaining after a burst of rounds is fired from the firearm.

Nevertheless, it is critical in both competitive and combat shooting for an individual to not overestimate the ammunition remaining in his or her firearm, and run out of ammunition at a critical moment. At the same time, tactical considerations dictate that a shooter make optimum use of his or her firearm and use as much ammunition as possible before each reloading. As a result, it is desirable for the user to know exactly the amount of ammunition remaining in the firearm at all times.

Even with a semiautomatic weapon, where each round is individually fired by the user, it is frequently difficult to keep track of the number of rounds remaining. If the semiautomatic weapon contains only a limited number of rounds, for example, a semiautomatic pistol, the user may be able to mentally count the number of rounds fired. However, during the stress of a combat situation or a competitive shooting event, a user will frequently lose track of the number of rounds fired and will not be certain of the number of rounds remaining in the firearm.

Various devices have been devised which include means for revealing the contents of a magazine. However, these devices are generally cumbersome and are not conveniently mounted on a previously manufactured firearm.

In view of the prior art, it is clear that a need continues to exist for a convenient and reliable gun handle grip providing a comfortable gripping surface. In addition, a need continues to exist for a gun handle grip provided with structure for viewing the number of rounds remaining in a magazine. The present invention provides such a gun handle grip.

SUMMARY OF THE INVENTION

It is, therefore, an object of the present invention to provide a gun handle grip including a first grip member and a second grip member. The first grip member has a first shell and a first reinforcing member bonded to an inner surface of the first shell and a second grip member having a second shell and a second reinforcing member bonded to an inner surface of the second shell. The inner surface of the first shell includes a first recess shaped to receive the first reinforcing member and the first reinforcing member is bonded to the first shell within the first recess. Similarly, the inner surface of the second shell includes a second recess shaped to receive the second reinforcing member and the second reinforcing member is bonded to the second shell within the second recess. The grip is further provided with structure for releasably securing the first grip member and the second grip member to opposite sides of the handle of a firearm.

It is also an object of the present invention to provide a gun handle grip including a first reinforcing flange on the first reinforcing member shaped to engage a second reinforcing flange on the second reinforcing member such that the first reinforcing flange selectively engages the second reinforcing flange in a manner facilitating the attachment of the first grip member and the second grip member to opposite sides of the handle of the firearm.

It is another object of the present invention to provide a gun handle grip wherein the first reinforcing flange is positioned adjacent a rear end of the first grip member and the second reinforcing flange is positioned adjacent a rear end of the second grip member, and the first reinforcing flange and the second reinforcing flange pass about a rear surface of the handle of the firearm when the gun handle grip is secured thereto.

It is a further object of the present invention to provide a gun handle grip wherein the first reinforcing member is L-shaped and the second reinforcing member is L-shaped.

It is also an object of the present invention to provide a gun handle grip wherein the first shell and the second shell are coupled by a finger grip member positioned between a forward end of the first shell and a forward end of the second shell, forming a unitary single piece gun handle grip.

It is another object of the present invention to provide a gun handle grip wherein the finger grip member is resiliently coupled to the first shell and the finger grip member is resiliently coupled to the second shell.

It is a further object of the present invention to provide a grip for a firearm including a first grip member having a first shell and a first transparent reinforcing member coupled to the first shell, and a second grip member having a second shell and a second reinforcing member coupled to the second shell. The first shell includes a first grip opening positioned to be adjacent the magazine compartment of the firearm, wherein the first transparent reinforcing member covers the first grip opening such that an individual may look through the first grip opening and the first transparent reinforcing member to view the number of rounds remaining. The grip further includes structure for releasably securing the first grip member and the second grip member to opposite sides of the handle of the firearm.

It is also an object of the present invention to provide a grip for a firearm wherein the second shell includes a second grip opening positioned to be adjacent the magazine compartment and the second reinforcing member is transparent. The second reinforcing member covers the second grip opening such that an individual may look through the second grip opening and the second reinforcing member to view the number of rounds remaining in the firearm.

Other objects and advantages of the present invention will become apparent from the following detailed description when viewed in conjunction with the accompanying drawings, which set forth certain embodiments of the invention.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as the basis for the claims and as a basis for teaching one skilled in the art how to make and/or use the invention.

Figure 1:
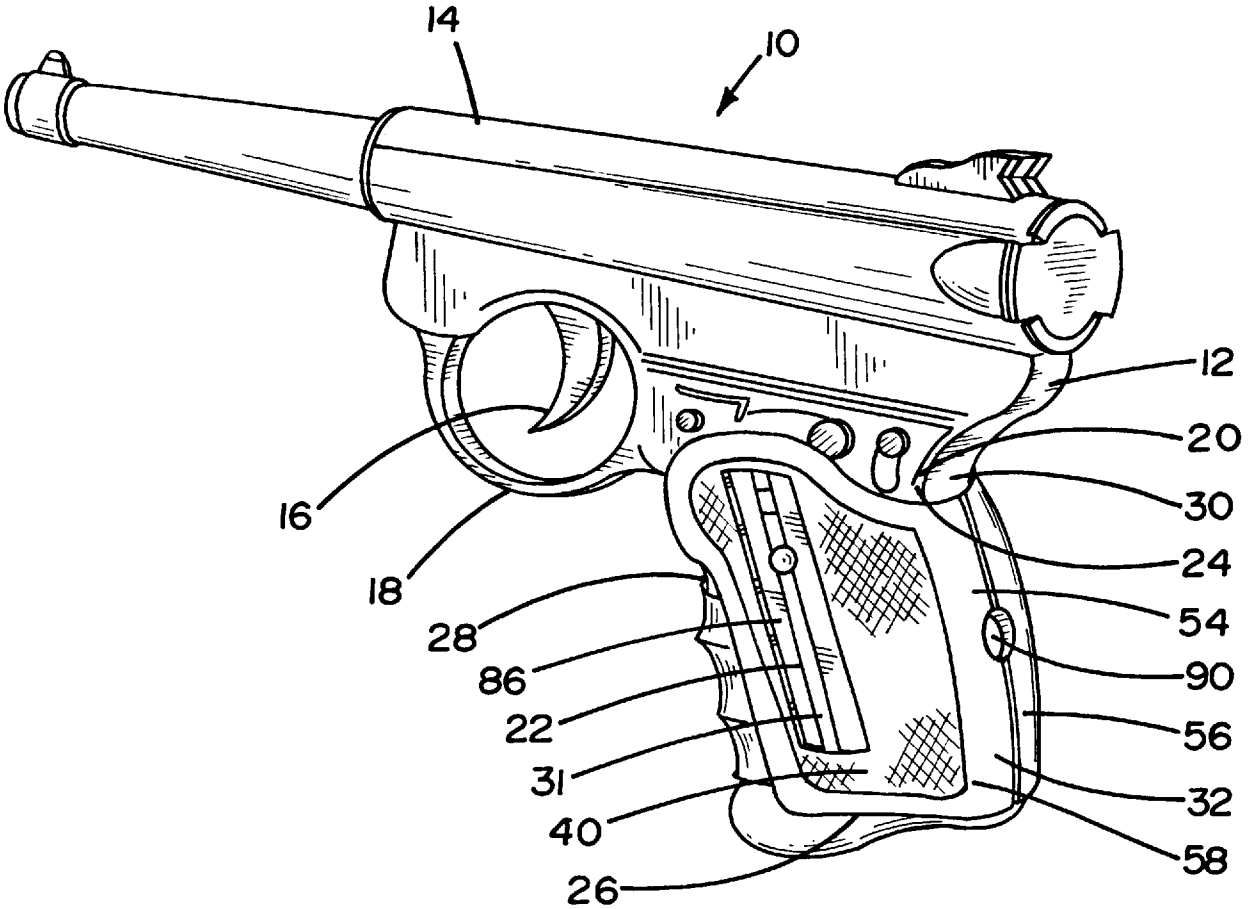
FIG. 1 is a perspective view of a hand gun with the present gun handle grip secured thereto.
Figure 2:
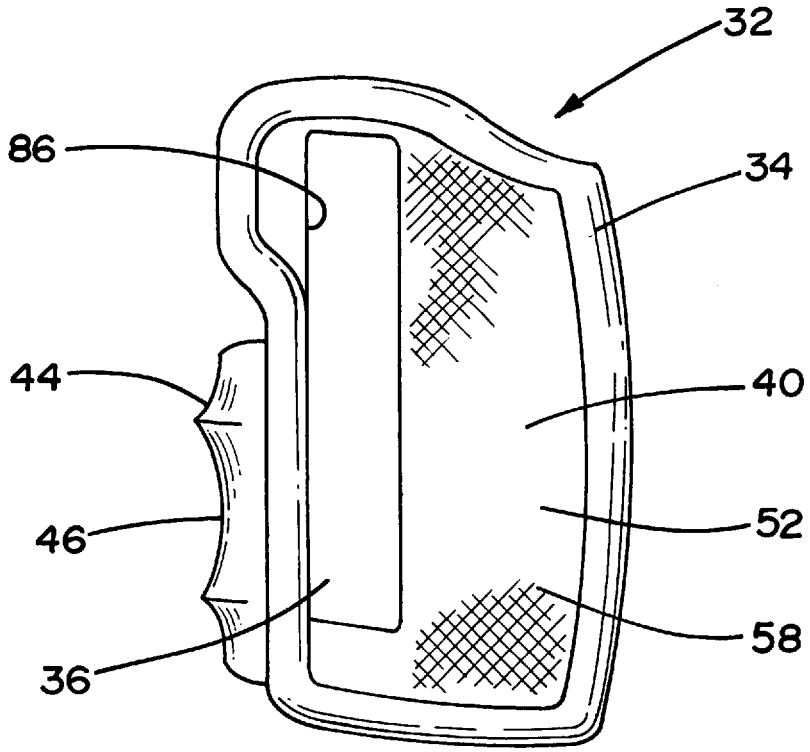
FIG. 2 is a side view of the present gun handle grip.

With reference to FIG. 1, a gun handle grip 32 is disclosed. The gun handle grip 32 is designed for attachment to the handle 20 of a hand gun 10, although the grip could be employed with other firearms without departing from the spirit of the present invention. As shown in FIG. 1, a conventional hand gun 10 includes a frame 12 and a barrel 14. The hand gun 10 includes a trigger 16 received within a trigger loop 18 of the frame 12. The trigger 16 controls the firing of a round when it is compressed by an individual. The frame 12 further includes a handle 20 extending downwardly and rearwardly from the frame 12. The handle 20 includes an interior magazine compartment 22 in which a magazine of rounds is inserted for use.

Generally, the handle 20 is provided with a planar first side surface 24 and a second side surface (not shown) extending parallel to and equidistant from a central vertical front to rear plane of the hand gun 10. The bottom end 26 of the handle 20 is defined by a horizontal planar undersurface. The front surface 28 of the handle 20 extends upwardly and then curves gradually forwardly to the location of a shoulder formed by the frame 12. The rear surface 30 of the handle 20 extends upwardly from undersurface. Openings 31 along the first and second side surfaces are formed in the handle 20. The openings 31 permit an individual to view the rounds held in a magazine while it sits within the magazine compartment 22 of the handle 20.

As discussed above, it is often desirable to replace the grip supplied with a hand gun with a more comfortable and/or functionally useful gun handle grip 32. The present gun handle grip 32 includes a flexible grip shell 34 with reinforcing members 36, 38 bonded thereon. The grip shell 34 is preferably made of an injection moldable elastomer (for example, rubber), although other materials could be used without departing from the spirit of the present invention. The grip shell 34 is constructed from a first shell 40 shaped to cover the first side surface 24 of the handle 20 of the hand gun 10 and a second shell 42 shaped to cover the second side surface of the handle 20 of the hand gun 10. The first shell 40 and the second shell 42 are connected adjacent their front ends by a finger grip member 44.

The finger grip member 44 is shaped to fit over the front surface 28 of the handle 20 of the hand gun 10, and is provided with grooved portions 46 shaped to accommodate the fingers of a hand gun user. Similarly, the first shell 40 includes an inner surface 48 shaped to conform with the first side surface 24 of the handle 20 of the hand gun 10 and the second shell 42 includes an inner surface 50 shaped to conform with the second side surface of the handle 20 of the hand gun 10. The outer surfaces 52 of the first shell 40 and the second shell 44 are preferably textured to provide an individual with a comfortable gripping surface.

The first shell 40, second shell 42 and finger grip member 44 form the flexible grip shell 34 which is shaped to entirely encompass the handle 20 of the hand gun 10. With this in mind, the first shell 40 and the second shell 42 are respectively provided with a first rear flange 54 and a second rear flange 56. The first rear flange 54 and the second rear flange 56 are shaped to meet at the rear surface 30 of the handle 20 and cover the rear surface 30 of the handle 20 of the hand gun 10.

Reinforcing members 36, 38 provide stability to the gun handle grip 32. Specifically, a first L-shaped reinforcing member 36 is bonded to the inner surface 48 of the first shell 40 to form a first grip member 58 and a second L-shaped reinforcing member 38 is bonded to the inner surface 50 of the second shell 42 to form a second grip member 60. The first and second reinforcing members 36, 38 are respectively bonded to the inner surfaces 48, 50 of the first shell 40 and the second shell 42 such that the first and second grip members 58, 60 are provided with smooth inner surfaces that may be positioned against the side surfaces 24 of the handle 20 of the hand gun 10. The first and second reinforcing members 36, 38 are preferably made from a rigid transparent material, for example, clear nylon. While clear nylon is disclosed for use with the preferred embodiment, other materials could be used without departing from the spirit of the present invention. The transparent first and second reinforcing members 36, 38 permit an individual to view the number of rounds remaining in the magazine compartment 22 of the hand gun 10 in a manner that will be discussed below in greater detail.

The first and second reinforcing members 36, 38 are respectively bonded to the inner surfaces 48, 50 of the first and second shells 40, 42 in the following manner. The first shell 40 is provided with a first recess 62 on its inner surface 48. The first recess 62 is shaped to receive the first reinforcing member 36 in a manner providing the first grip member 58 with a substantially smooth inner surface. As such, the first recess 62 has a depth which substantially equals the thickness of the first reinforcing member 36. Similarly, the second shell 42 is provided with a second recess 64 on its inner surface 50. The second recess 64 is shaped to receive the second reinforcing member 38 in a manner providing the second grip member 60 with a substantially smooth inner surface. As with the first recess 62, the second recess 64 has a depth substantially equal to the thickness of the second reinforcing member 38. The first and second reinforcing members 36, 38 are respectively bonded within the recesses 62, 64 of the first and second shells 40, 42. The first and second reinforcing members are either thermally bonded or glued within the recesses of the first and second shells, although other bonding techniques may be employed without departing from the spirit of the invention.

The first and second reinforcing members 36, 38 are respectively provided with first and second reinforcing flanges 66, 68 extending away from the first and second shells 40, 42. The first reinforcing flange 66 and the second reinforcing flange 68 are shaped such that they may be selectively coupled to facilitate the attachment of the gun handle grip 32 to the handle 20 of the hand gun 10.

Figure 3:
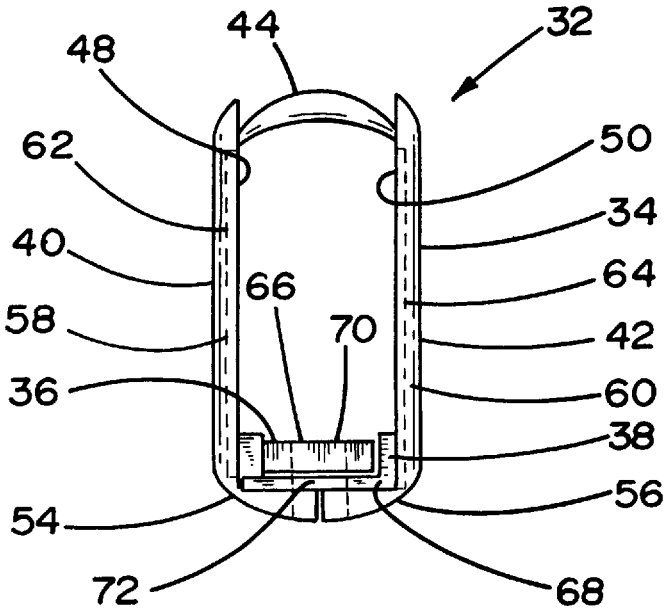
FIG. 3 is a top view of the present gun handle grip.
Figure 4:
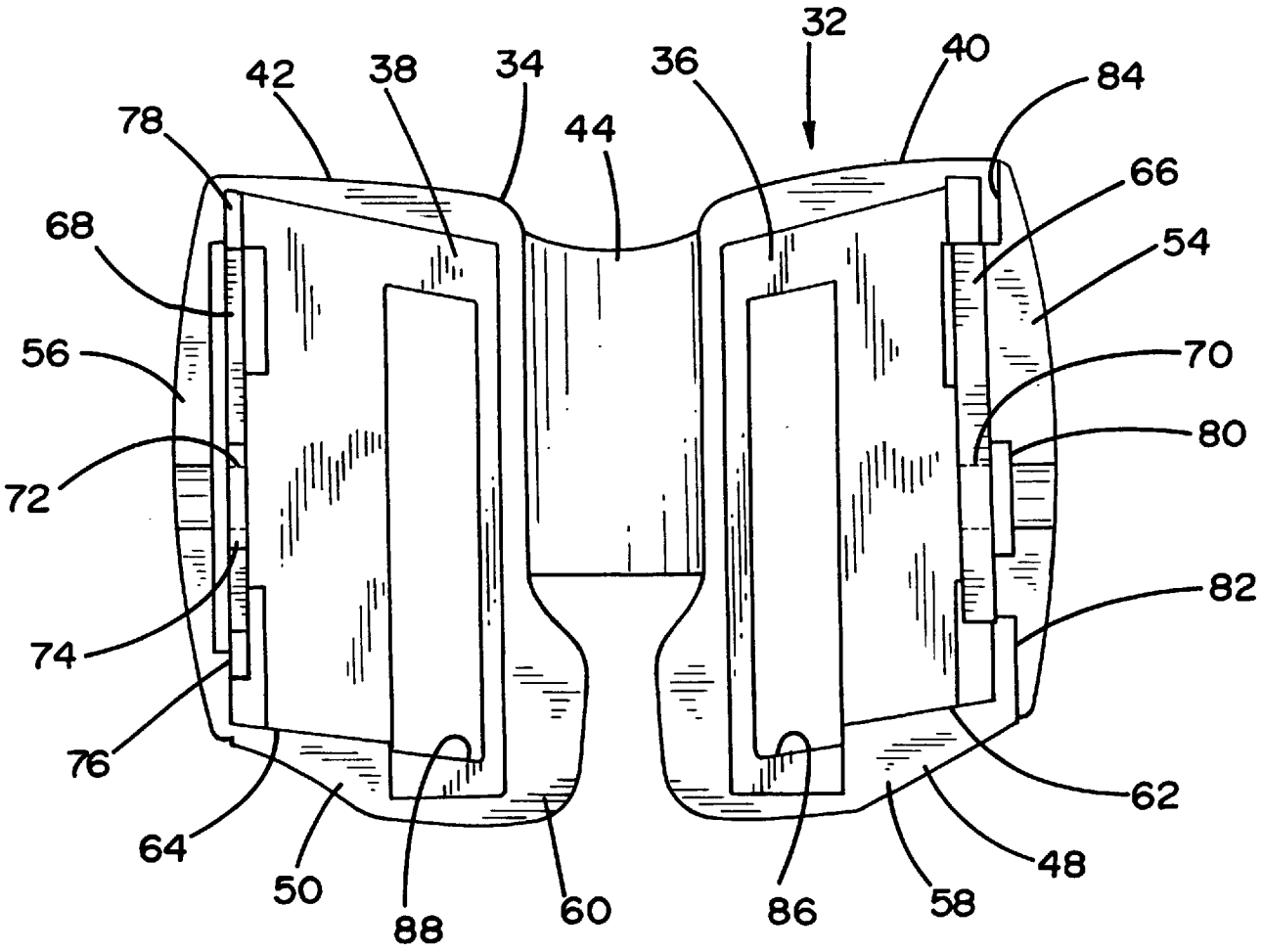
FIG. 4 is a perspective view of the opened gun handle grip.

In accordance with the preferred embodiment of the present invention, the first reinforcing flange 66 is substantially rectangular and is provided with a first hole 70 shaped and positioned to align with a second hole 72 in the second reinforcing flange 68. The second reinforcing flange 68 includes a central outwardly extending member 74, in which the second hole is positioned, as well as first and second laterally disposed arms 76, 78. As shown in FIGS. 3 and 4, the second reinforcing flange 68 is shaped such that it may be positioned over the first flange 6 with the first and second holes 70, 72 aligned. Since the first and second flanges 54, 56 of the first and second shells 40, 42 must meet at the rear surface 30 of the handle 20 of the hand gun 10, the first flange 54 is provided with first, second and third recesses 80, 82, 84 shaped to respectively receive the central outwardly extending member 74, the first laterally disposed arm 76, and the second laterally disposed arm 78 when the second reinforcing flange 68 is positioned over the first reinforcing flange 66 (with the first and second holes aligned).

The present gun handle grip permits a user to view the number of rounds remaining in the magazine compartment 22 of the hand gun 10. As such, the first shell 40 is provided with a first grip opening 86 positioned to be adjacent the first opening 31 within the first side surface 24 of the handle 20. The first reinforcing member 36 covers the first grip opening 86 such that an individual may look through the first grip opening 86 and the first transparent reinforcing member 36 to view the number of rounds remaining in the hand gun 10. Similarly, the second shell 42 is provided with a second grip opening 88 positioned to be adjacent the second opening within the second side surface of the handle 20. The second reinforcing member 38 covers the second grip opening 88 such that an individual may look through the second grip opening 88 and the second transparent reinforcing member 38 to view the number of rounds remaining in the hand gun 10.

In use, the grip provided with the hand gun is removed to accommodate the attachment of the present grip to the handle of the hand gun. The present hand gun grip is then wrapped around the handle such that the finger grip member 44 is positioned on the front surface 28 of the handle 20, the first grip member 58 is positioned on the first side 24 of the handle 20 and the second grip member 60 is positioned on the second side of the handle 20. The first reinforcing flange 66 and the second reinforcing flange 68 are then engaged such that the second reinforcing flange 68 lies on top of the first reinforcing flange 66 with the first and second holes 70, 72 aligned. When the first and second holes 70,72 are aligned, the first flange and the second flange 54, 56 of the first and second shells 40, 42 cover the rear surface 30 of the handle 20 of the hand gun 10. A screw 90 is then inserted through the first and second holes 70, 72, and into a screw hole formed in the handle of the hand gun 10 to securely attach the gun handle grip 32 to the handle 20.

While the preferred embodiment has been shown and described, it will be understood that there is no intent to limit the invention by such disclosure, but rather, is intended to cover all modifications and alternate constructions falling within the spirit and scope of the invention as defined in the appended claims.

I claim:

1. A gun handle grip, comprising:

a first grip member shaped and dimensioned to fully cover a handle of a firearm, the first grip member having a first shell and a first reinforcing member bonded within a first recess formed in an inner surface of the first shell such that the first reinforcing member is exposed along an inner surface of the first grip member and a second grip member shaped and dimensioned to fully cover a handle of a firearm, the second grip member having a second shell and a second reinforcing member bonded within a second recess formed in an inner surface of the second shell such that the second reinforcing member is exposed along an inner surface of the second grip member; and means for releasably securing the first grip member and the second grip member to opposite sides of a handle of a firearm.

2. The gun handle grip according to claim 1, wherein the means for releasably securing the first grip member and the second grip member includes a first reinforcing flange on the first reinforcing member shaped to engage a second reinforcing flange on the second reinforcing member such that the first reinforcing flange selectively engages the second reinforcing flange in a manner facilitating the attachment of the first grip member and the second grip member to opposite sides of the handle of the firearm.

3. The gun handle grip according to claim 2, wherein the first reinforcing flange is positioned adjacent a rear end of the first grip member and the second reinforcing flange is positioned adjacent a rear end of the second grip member, and the first reinforcing flange and the second reinforcing flange pass about a rear surface of the handle of the firearm when the gun handle grip is secured thereto.

4. The gun handle grip according to claim 1, wherein the first reinforcing member is L-shaped and the second reinforcing member is L-shaped.

5. The gun handle grip according to claim 4, wherein the first reinforcing member includes a first reinforcing flange extending away from the first shell and the second reinforcing member includes a second reinforcing flange extending away from the second shell, and the first reinforcing flange and the second reinforcing flange may be selectively engaged to facilitate attachment of the first grip member and the second grip member to opposite sides of the handle of the firearm.

6. The gun handle grip according to claim 1, wherein the first shell and the second shell are coupled by a finger grip member positioned between a forward end of the first shell and a forward end of the second shell, forming a unitary single piece gun handle grip.

7. The gun handle grip according to claim 6, wherein the finger grip member is resiliently coupled to the first shell and the finger grip member is resiliently coupled to the second shell.

8. A grip for coupling to a handle of a firearm, wherein the handle includes a magazine compartment containing rounds such that the rounds, or other indicator, may be viewed through a wall of the handle, comprising:

a first grip member having a first shell and a first transparent reinforcing member bonded within a first recess formed in an inner surface of the first shell, such that the first reinforcing member is exposed along an inner surface of the first grip member and a second grip member having a second shell and a second reinforcing member bonded within a second recess formed in an inner surface of the second shell, such that the second reinforcing member is exposed along an inner surface of the second grip member;

the first shell including a first grip opening positioned to be adjacent the magazine compartment, wherein the first transparent reinforcing member covers the first grip opening such that an individual may look through the first grip opening and the first transparent reinforcing member to view the number of rounds remaining in the magazine compartment; and means for releasably securing the first grip member and the second grip member to opposite sides of the handle of the firearm.

9. The gun handle grip according to claim 8, wherein the second shell includes a second grip opening positioned to be adjacent the magazine compartment and the second reinforcing member is transparent, and wherein the second reinforcing member covers the second grip opening such that an individual may look through the second grip opening and the second reinforcing member to view the number of rounds remaining in the firearm.

10. The gun handle grip according to claim 9, wherein the means for releasably securing the first grip member and the second grip member includes a first reinforcing flange on the first transparent reinforcing member shaped to engage a second reinforcing flange on the second reinforcing member such that the first reinforcing flange selectively engages the second reinforcing flange in a manner facilitating the attachment of the first grip member and the second grip member to opposite sides of the handle of the firearm.

11. The grip according to claim 9, wherein the first shell and the second shell are coupled by a finger grip member positioned between a forward end of the first shell and a forward end of the second shell, forming a unitary single piece grip.

12. The grip according to claim 8, wherein the means for releasably securing the first grip member and the second grip member includes a first reinforcing flange on the first transparent reinforcing member shaped to engage a second reinforcing flange on the second reinforcing member such that the first reinforcing flange selectively engages the second reinforcing flange in a manner facilitating the attachment of the first grip member and the second grip member to opposite sides of the handle of a firearm.

13. The gun handle grip according to claim 12, wherein the first reinforcing flange is positioned adjacent a rear end of the first grip member and the second reinforcing flange is positioned adjacent a rear end of the second grip member, and the first reinforcing flange and the second reinforcing flange pass about a rear surface of the handle of the firearm when the gun handle grip is secured thereto.

14. The grip according to claim 8, wherein the first shell and the second shell are coupled by a finger grip member positioned between a forward end of the first shell and a forward end of the second shell, forming a unitary single piece grip.

15. The grip according to claim 14, wherein the finger grip member is resiliently coupled to the first shell and the finger grip member is resiliently coupled to the second shell.

16. A gun handle grip, comprising:

a first grip member having a first shell and a first L-shaped reinforcing member bonded to an inner surface of the first shell, and a second grip member having a second shell and a second L-shaped reinforcing member bonded to an inner surface of the second shell;

the first reinforcing member includes a first reinforcing flange and the first shell includes a first rear flange partially covering the first reinforcing flange, and the second reinforcing member includes a second reinforcing flange and the second shell includes a second rear flange partially covering the second reinforcing flange; and wherein the first reinforcing flange and the second reinforcing flange are selectively engaged to facilitate the attachment of the first grip member and the second grip member to opposite sides of a handle of a firearm, while the first rear flange and the second rear flange are shaped to meet at a rear surface of the handle of the firearm and cover the rear surface of the handle of the firearm.

17. The gun handle grip according to claim 16, wherein the first reinforcing flange is positioned adjacent a rear end of the first grip member and the second reinforcing flange is positioned adjacent a rear end of the second grip member, and the first reinforcing flange and the second reinforcing flange pass about a rear surface of the handle of the firearm when the gun handle grip is secured thereto.

18. The gun handle grip according to claim 17, wherein the first shell and the second shell are coupled by a finger grip member positioned between a forward end of the first shell and a forward end of the second shell, forming a unitary single piece gun handle grip.

19. The gun handle grip according to claim 16, wherein the first shell and the second shell are coupled by a finger grip member positioned between a forward end of the first shell and a forward end of the second shell, forming a unitary single piece gun handle grip.

20. The gun handle grip according to claim 19, wherein the finger grip member is resiliently coupled to the first shell and the finger grip member is resiliently coupled to the second shell.

* * * * *